US008291833B2

(12) United States Patent
Skiba

(10) Patent No.: US 8,291,833 B2
(45) **Date of Patent: *Oct. 23, 2012**

(54) ADJUSTABLE DESK AND FOOTREST ASSEMBLY

(75) Inventor: Timothy A. Skiba, Osceola, WI (US)

(73) Assignee: Safco Products Company, New Hope, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/301,299

(22) Filed: Nov. 21, 2011

(65) Prior Publication Data

US 2012/0067255 A1 Mar. 22, 2012

Related U.S. Application Data

(63) Continuation of application No. 12/350,652, filed on Jan. 8, 2009, now Pat. No. 8,061,278.

(60) Provisional application No. 61/010,788, filed on Jan. 11, 2008.

(51) Int. Cl.
*A47B 37/00* (2006.01)

(52) U.S. Cl. ..... 108/50.01; 312/196; 297/423.15

(58) Field of Classification Search ..... 108/50.01, 108/50.02; 297/423.15, 423.16, 423.25, 297/426.28, 423.2, 423.22, 423.23, 423.24, 297/423.26, 423.3, 423.29, 423.19; 248/918, 248/919, 920; 312/196, 194, 195, 257.1, 312/702, 208, 7.2, 208.1
See application file for complete search history.

(56) References Cited

U.S. PATENT DOCUMENTS

| | | | | | |
|---|---|---|---|---|---|
| 1,652,774 | A * | 12/1927 | Fraser et al. | ..... | 312/233 |
| 1,975,004 | A * | 9/1934 | Jenkins | ..... | 312/195 |
| 2,284,129 | A * | 5/1942 | Caesar | ..... | 297/423.15 |
| 2,306,864 | A * | 12/1942 | Caesar et al. | ..... | 297/423.15 |
| 3,375,039 | A * | 3/1968 | Gielow et al. | ..... | 297/423.15 |
| 3,632,169 | A * | 1/1972 | Barecki et al. | ..... | 297/423.15 |
| 5,174,223 | A * | 12/1992 | Nagy et al. | ..... | 108/50.01 |
| 6,375,266 | B1 * | 4/2002 | Ferguson et al. | ..... | 297/423.15 |
| 7,108,329 | B1 * | 9/2006 | Clough | ..... | 297/423.19 |
| 7,490,559 | B2 * | 2/2009 | Bentschneider | ..... | 108/50.01 |
| 2004/0065235 | A1 * | 4/2004 | de Oliveira | ..... | 108/50.01 |
| 2008/0296957 | A1 * | 12/2008 | Clough | ..... | 297/423.15 |

* cited by examiner

*Primary Examiner* — Jose V Chen
(74) *Attorney, Agent, or Firm* — Barnes & Thornburg LLP

(57) ABSTRACT

A universal desk or workstation assembly for enhancing learning is incrementally adjustable in height from sitting to standing positions, and includes a pendulum swinging footrest assembly. The swinging footrest assembly may be provided in kit form and is configurable for retrofit attachment to existing desks and workstations. The swinging footrest provides height adjustment and mounting depth adjustment relative to the depth of the desk or workstation.

5 Claims, 7 Drawing Sheets

ADJUSTABLE DESK AND FOOTREST ASSEMBLY

RELATED APPLICATIONS

This present application is a continuation of U.S. Utility application Ser. No. 12/350,652, filed Jan. 8, 2009, entitled "Adjustable Desk and Footrest Assembly." The present application relates to and claims priority to U.S. Provisional Patent Application Ser. No. 61/010,788, filed Jan. 11, 2008, entitled: Adjustable Desk and Footrest Assembly." To the extent not included below, the subject matter disclosed in those applications is hereby expressly incorporated into the present application.

FIELD OF INVENTION

This invention relates generally to furniture and more particularly to a use-flexible desk or work station and a movable footrest therefore.

BACKGROUND

Traditionally institutional stand-alone desks and workstations have been configured for limited end-use situations. For example, school desks are typically configured for use by seated students and have very limited or no height adjustment. Such limited adjustment generally limits the scope or use of such desks to a small range of age groups, requiring schools and institutions using such desks to carry large inventories of desks of differing sizes and height adjustable ranges, to accommodate varying sizes of students from different age groups.

Recent studies have suggested that student learning may be improved as a result of greater comfort and attention if the desk is configured such that the student can stand while using the desk. Studies suggest that stand-up learning might be particularly beneficial for students with excess energy or short attention spans, such as may be the case for those suffering from Attention Deficit Disorder (ADD) or Attention Deficit Hyperactivity Disorder (ADHD). Studies also suggest that freedom of movement afforded to a standing student improves one's comfort in the classroom, leading to better posture and longer attention spans of quality time to the task being considered. The freedom of movement can also help students burn off excess energy and may help increase calorie expenditure. Further, studies have also shown that extended sitting is the biggest cause of musculoskeletal disorders, particularly back pain in office workers. Standing at a desk improves ergonomic posture and provides stress relief for the lower back.

Conventional desks typically do not include height adjustment features that will allow the desks to be adjustably elevated to accommodate a standing student. Further, while standup "work stations" and drafting tables exist that allow their users to stand, the height adjustability of such work stations is also very limited, with such work stations being generally configured to accommodate users sitting upon stools of predetermined height.

Further, stand-alone desks and work stations have traditionally not included movable footrests that can further add to the user's comfort and relaxation while using the desk/work station. Footrests that are fixed to the desk chair or to the desk have long been known. Footrests configured for affixation to desks and having limited rotational motion, typically about a single pivot axis are also known, as illustrated for example in U.S. Pat. Nos. 1,203,260; 1,975,004 and 5,826,941. Such known footrests, however, are generally not well adapted or suitable with use for stand-up desks or work stations, and therefore do not adequately address fatigue or discomfort of the user of such stand-up desks or work stations.

The present invention addresses the above-discussed shortcomings of desks and work stations by providing a desk design that is universally adaptable and adjustable for sit-down or stand-up use in a manner that offers compatibility with individual user comfort and stress reduction needs and addresses ergonomic health and learning needs.

SUMMARY OF THE DISCLOSURE

The present invention provides a desk or a work station design that can be rapidly adjusted between a full range of height adjustments from a normal sit down user position to a stand-up position. As used herein, the terms "desk" and "work station" will be used interchangeably and understood to be synonymous with one another. The desk height can readily be adjusted over a wide range of heights in relatively small increments to accommodate the specific needs and requirements of individual users. When used in a school or learning environment, the same desk can be used for a wide range of ages and student sizes, for example, from kindergarten to high school, thereby enabling less desk inventory and expenses for an educational facility since the desks can be readily adjusted and moved among classrooms.

The desk can be configured to accommodate upper work surfaces of varied sizes and shapes, and can be made from various materials, colors and textures, preferably of durable scratch resistant materials that can withstand frequent cleaning by caustic or harsh cleaning agents. The desk can be configured with one or more book, computer or other article-holding shelves and compartments as well as with electrical supply and/or outlet capabilities, and/or pencil cup or holder features. The desk is preferably configured with a plurality of adjustable telescoping legs, but could also have a single height adjustable pedestal support structure.

The present invention also provides a novel swingable footrest assembly that is configurable for use with a desk or work station when adjusted in either sit down or stand-up use modes. That portion of the footrest assembly which supports a person's foot is positioned for movement relatively close to the floor and has a swing radius about a first axis positioned appreciably above the level of the foot engaging member, to provide the user with relaxing swinging foot motion. The footrest assembly may be secured to the desk legs, to cross-bars supports between the legs, or from the lower surface or support structure of the upper desk surface. The footrest axis about which the footrest swings may also be adjustably mountable to the desk relative to the front to back direction of the desk. Preferably the desk will be configured such that the first mounting axis of the footrest can be rapidly selectively moved between a plurality of predetermined mounting positions. The footrest also preferably has a pedal-like member upon which the user's foot rests which is pivotable about a second axis adjacent to and longitudinally extending along the length of the pedal member. The footrest assembly may be an integral part of the desk assembly, or may be configured as an add-on accessory, possibly in kit form, for an existing desk, work station or other piece of furniture.

These and other alternative configurations and features and advantages of the present invention will be recognized by those skilled in the art in view of the following description of preferred embodiments of the invention. The description of such preferred embodiments of the invention are presented to acquaint the reader with the unique and novel features and principles of the invention and are not intended to be construed so as to limit the scope of the invention.

BRIEF DESCRIPTION OF THE DRAWING

Referring to the drawing, wherein like numbers represent like parts throughout the several views.

DESCRIPTION OF THE PREFERRED EMBODIMENT

Figure 1:
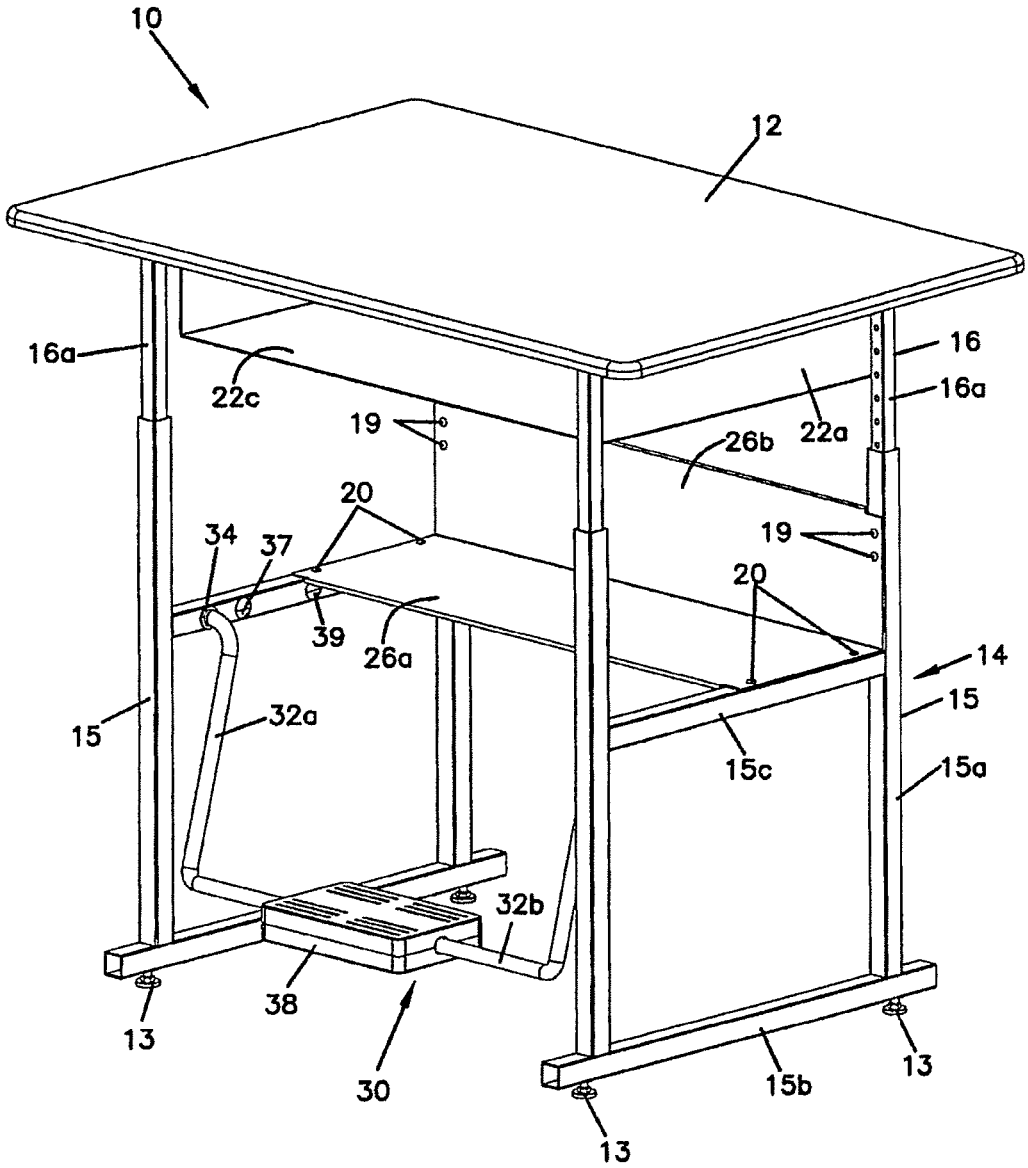
FIG. 1 is a perspective view of one embodiment of an adjustable desk configured according to the principles of this invention.
Figure 2:
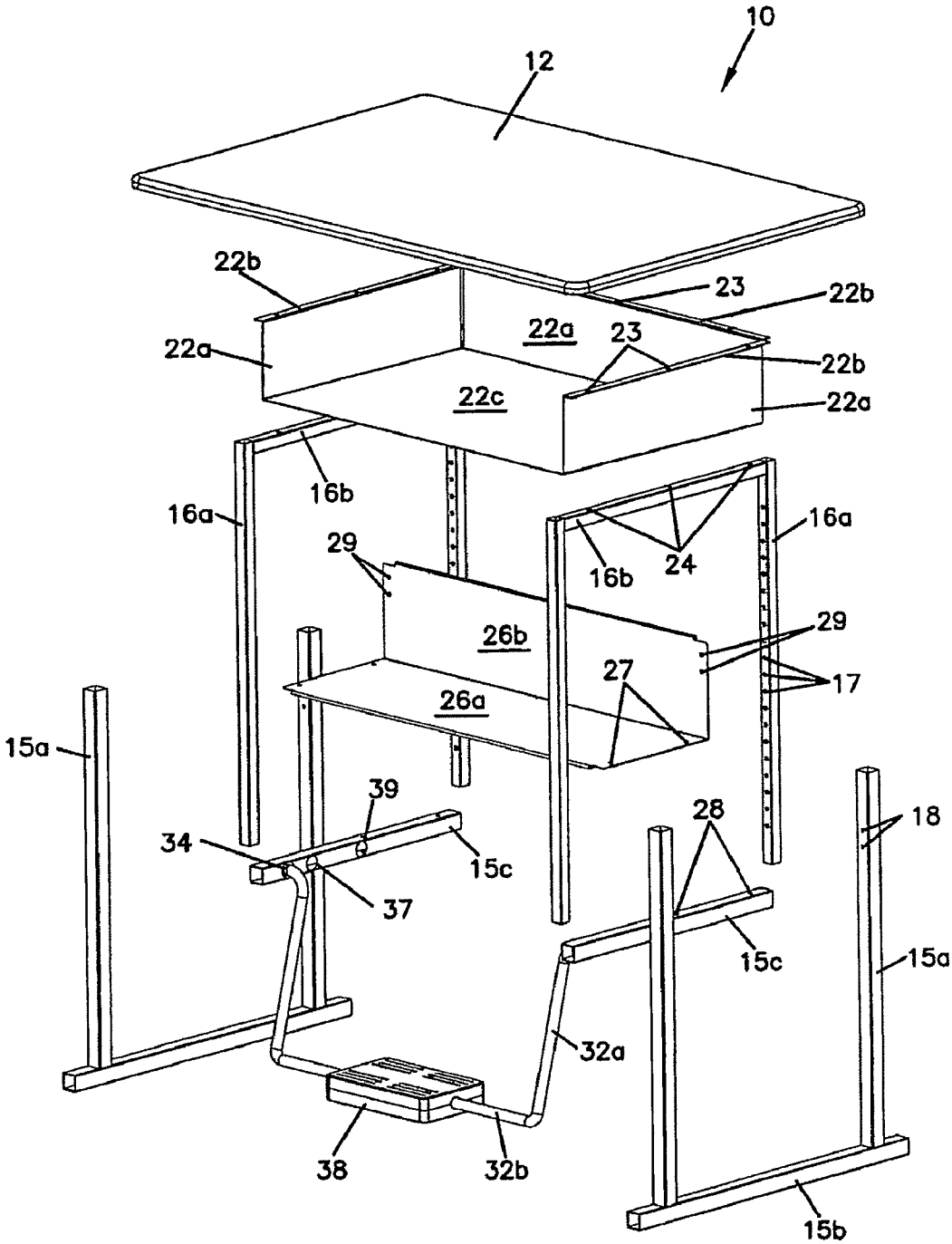
FIG. 2 is a diagrammatic exploded view of the desk of FIG. 1.

FIGS. 1-5 disclose a preferred construction of an adjustable desk 10 configured according to the principles of this invention. It will be understood that the invention is not limited to the specifics of the particular desk construction to be described. Referring to FIGS. 1 and 2, the desk 10 has an upper portion or top 12 with a, generally planar top work surface sized and configured to accommodate the needs of the user or particular environment in which the desk will be used. In the embodiment illustrated, the shape of the top work surface 12 is rectangular; however, it would be understood that the work surface may be configured in other shapes and geometric configurations. Typical preferable sizes of classroom desks for schools range from about 20×28 inches to about 24×36 inches for rectangular-shaped desk tops.

In the embodiment illustrated, the top work surface is supported by a pair of oppositely disposed side support leg structures 14. Each of the side support leg structures includes a lower leg assembly 15 and an upper leg assembly 16. Each lower leg assembly 15 includes a pair of tubular upright support legs 15*a* arranged in generally vertical spaced parallel manner and connected at their lower ends by means of a lower cross bar 15*b*. The lower crossbar or brace is configured to be supported on a generally flat surface or floor by means of a pair of vertically adjustable glides 13. The upright support legs 15*a* are further interconnected along their length, approximately midway therealong by a second, intermediate crossbar 15*c*.

The upper leg assembly 16 comprises an inverted U-Shaped configuration having a pair of downwardly depending parallel spaced tubular support legs 16*a* sized and configured to telescopically mattingly slide within the lower support leg members 15*a*. The upper ends of the upper support leg members 16*a* are connected by means of an upper crossbar 16*b* (FIG. 2). In the preferred embodiment, the lower crossbar 15*b*, the intermediate crossbar 15*c* and the upper crossbar 16*b* are welded to the respective leg members to which they are connected. It may be preferable, in some instances, however, for the intermediate crossbar 15*c* to be vertically adjustably connected to the upright lower leg members 15*a*, for reasons that will become apparent upon a more detailed description of the invention. In the preferred embodiment illustrated, the upright support legs 15*a*, the lower crossbar 15*b* and the intermediate crossbar 15*c* members are constructed of one inch square hollow tubular steel material. The upper leg members 16*a* and upper crossbar members 16*b* are constructed of 0.75 in. square tubular steel material which cooperatively telescopically slides within the hollow tubular lower leg members 15*a*.

Figure 3:
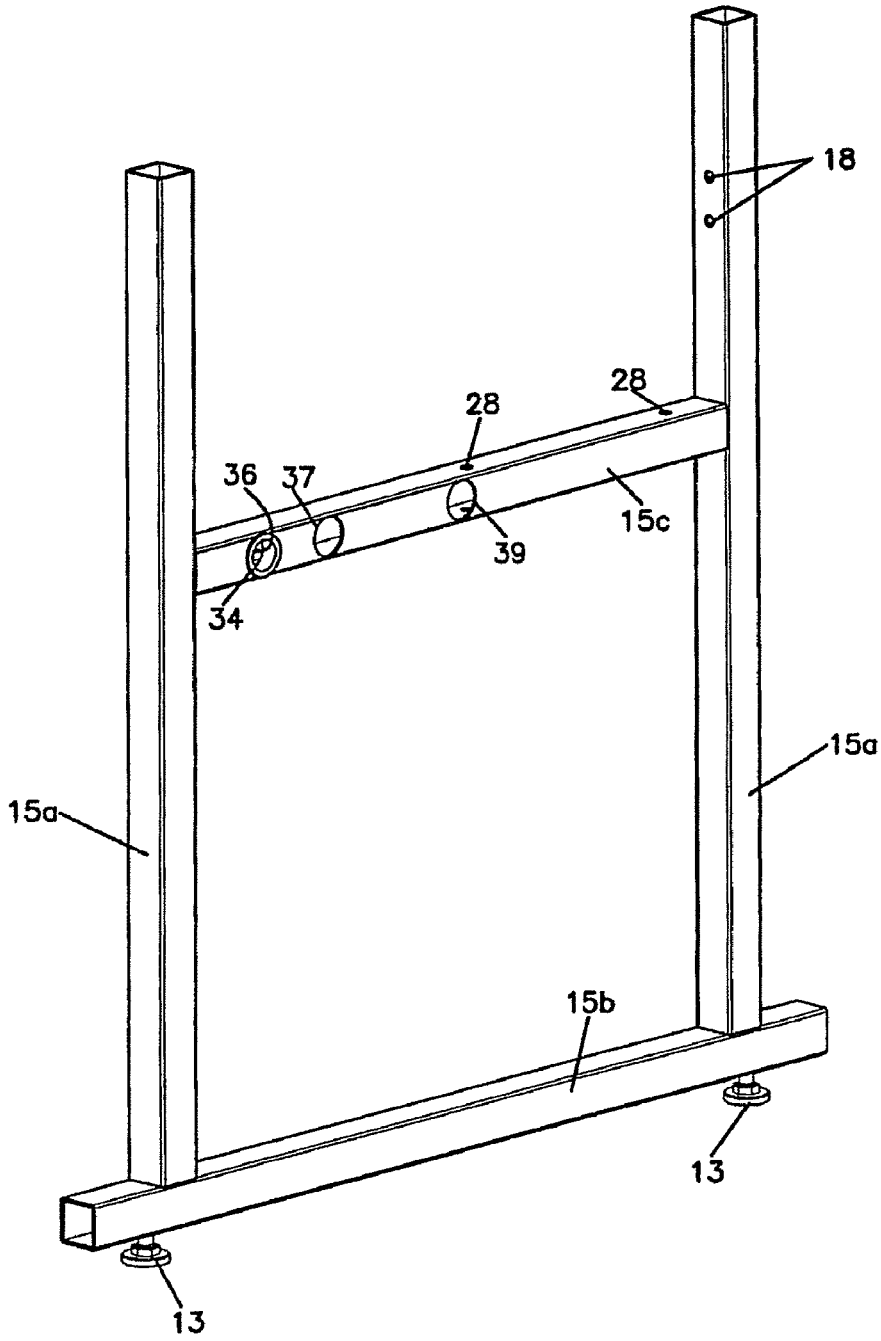
FIG. 3 is an enlarged perspective view of one side of the lower leg and crossbar portions of the desk of FIG. 1.
Figure 4A:
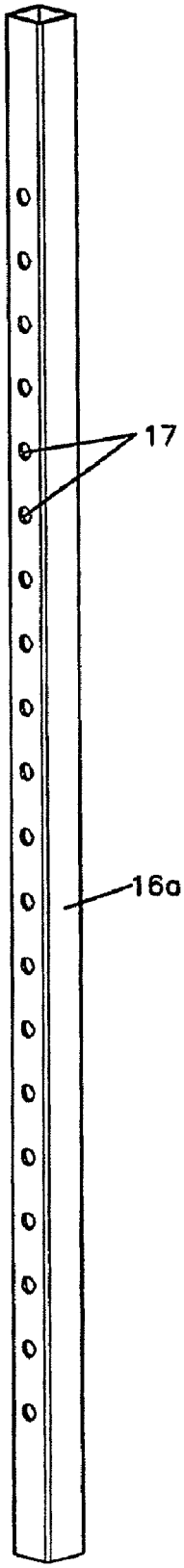
FIG. 4*a* is an enlarged perspective view of one of the upper leg portions of the desk of FIG. 1.
Figure 4B:
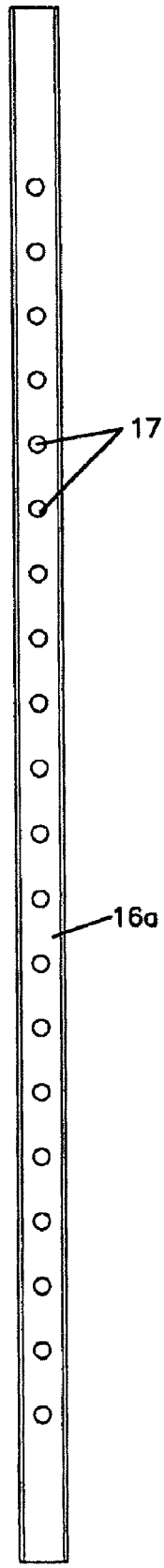
FIG. 4*b* is a front elevation view of the upper leg portion of FIG. 4*a;*
Figure 5A:
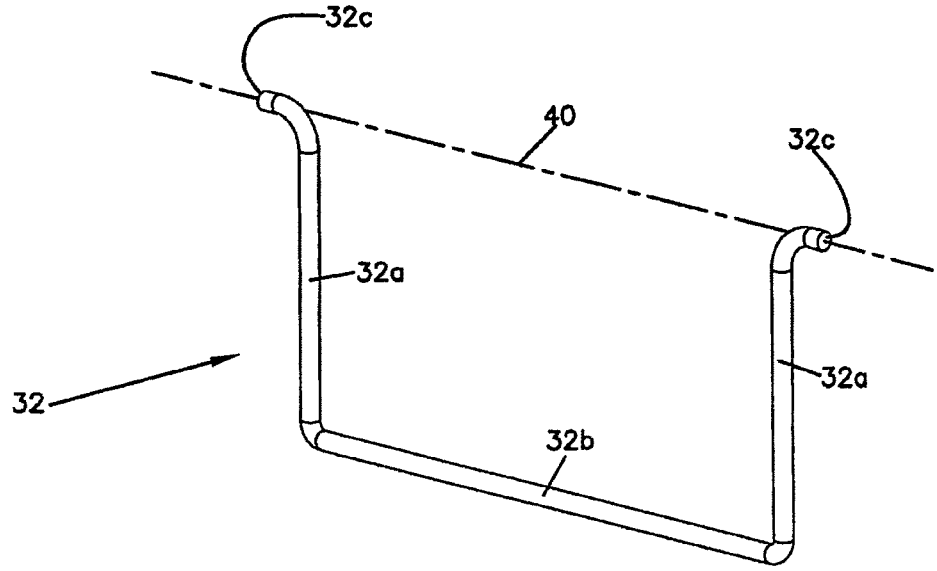
FIG. 5*a* is an enlarged perspective view of the foot arm portion of the desk of FIG. 1.
Figure 5B:
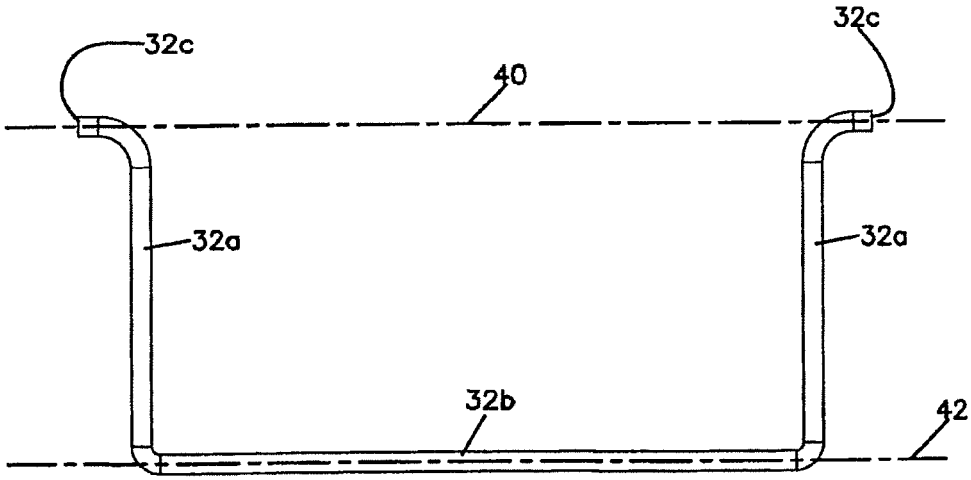
FIG. 5*b* is a front elevation view of the foot arm of FIG. 5*a;*

Referring to FIGS. 4*a* and 4*b*, the upper leg assembly members 16*a* have a plurality of regularly spaced holes 17 drilled through one of the leg surfaces. In the preferred embodiment, the holes 17 are spaced at 1 inch intervals along the upper leg members 16*a* with the lowermost hole being spaced about 2.25 inches from the lower end of the leg members 16*a* and the uppermost hole being spaced about 21.25 inches from the lower end of the leg members 16*a*. In the preferred embodiments, the upper leg members 16*a* have lengths respectively of about 24 inches. In the embodiment illustrated (see FIG. 3), the height of the lower leg assembly is about 23.5 inches and the outer width between the upright leg members 15*a* is about 18 inches.

A pair of longitudinally spaced holes 18 are formed through the inner upper surface of the back legs, as illustrated in FIG. 3 and are sized and spaced to identically align with the spaced holes 17 of the upper leg members 16*a* when inserted within the lower leg members 15*a*. The upper leg assembly 16 is vertically adjusted relative to the lower leg assembly 15 by sliding the upper leg members 16*a* longitudinally within the lower leg members 15*a* until two adjacent holes 17 of the upper leg members 16*a* align with the spaced holes 18 of the lower leg members 15*a* at a desired "height" of the desk top work surface 12 relative to the floor or desk support surface. At that position, a pair of fastener pegs or self-tapping screws 19 (FIG. 1) are inserted into the respectfully aligned holes 17,18, in each of the rear lower leg assemblies to secure the combined lower and upper leg assemblies 15,16 at the desired height.

While the leg assembly has been described with respect to a particular rectangular tubular configuration of leg members, it will be understood that the invention is not limited to such configuration and that other styles, shapes and configurations of leg assemblies can be used. Further, while the preferred embodiment described employs a plurality of leg support members, other leg structures such a single pedestal adjustable leg or other numbers of a plurality of legs could be used. Further, while a particular aligned hole and fastener configuration has been described for providing rapid height adjustment of the leg assemblies, it will be understood that other height adjustment techniques could be employed such as rotational screw adjustments, frictional sliding clamped arrangements, spring loaded button release mechanisms and the like. In the preferred embodiments, the height adjustment for the top surface of the upper work surface 12 of the desk preferably ranges between about 24 inches to about 48 inches from the floor and more preferably between about 26 inches to about 42 inches from the floor, which accommodates virtually any classroom needs, and enables the desk to be adjusted from a typical sit-down position up to a stand-up working position. It will be appreciated that other adjustment ranges are possible. When assembled, the base "footprint" area defined by the oppositely disposed lower crossbar members 15*b* is preferably about 26 inches wide by 22 inches deep.

The desk may be configured to incorporate one or more shelves or article holding compartments. The preferred embodiment desk illustrated in the figures incorporates two such article holding shelves. An upper object holding shelf 22 of a type typically found on desks for holding a student's books and other personal and/or school supplies is configured for mounting directly to and below the top work surface 12, as illustrated in FIGS. 1 and 2. The upper shelf 22 includes three upright side walls 22*a* connected at their bottom edges by a bottom plate 22*c*, and having upper edges extending outwardly as flanges 22*b* in a common plane and configured for directly engaging the lower surface of the desk top 12. A plurality of holes 23 are formed through the upper flanges 22*b* through which appropriate fasteners such as screws secure the upper shelf 22 to the bottom of the desk top 12. The spaced holes 23 of the flanges of the opposed outermost walls align with holes 24 drilled vertically through the upper crossbars 16*b*. Fastening screws (not illustrated) passing through the aligned holes 24 and 23 secure the upper leg assembly 16 and the upper shelf 22 to the top desk member 12. Fastening screws for the back upper wall member 22*a* of the upper shelf 22 pass through the holes 23 in the rear upper flange 22*b* to directly secure the upper flange of the rear wall member 22*a* to the desk top 12. The cavity defined between the desk top 12 and the lower plate 22*c* and by the three sidewalls 22*a* forms a receptacle for holding books and other articles as is well known in the art.

A second, lower L-shaped shelf 26 has a lower surface 26*a* mounted by self tapping screws 20 to the upper surfaces of the intermediate crossbars 15*c*. The self tapping screws 20 pass through holes 27 (FIG. 2) formed through the lower shelf surface 26*a* along its opposite ends and into aligned holes 28 (FIG. 3) of the intermediate crossbar 15*e*. The back vertical plate member 26*b* of the lower shelf 26 is secured to the pair of upright support leg members 15*a* of the lower leg assembly 15 by means of the height adjustment screws 19 through pairs of spaced holes 29 (FIG. 2) along the outer opposed edges of the shelf plate 26*b* which are aligned with the pairs of spaced holes 18 in the lower leg members 15*a*. The self tapping alignment screws 19 simultaneously connect the lower shelf back plate 26*b* to the leg assemblies as they secure the desired height adjustment between the lower and upper leg assemblies 15 and 16 as previously discussed.

The invention further includes a swinging footrest assembly generally indicated at 30 in FIG. 1. The footrest assembly 30 of the preferred embodiment illustrated includes a generally U-shaped downwardly depending support arm 32 having a pair of spaced upright arm portions 32*a* and a lower transverse bar member 32*b* connecting the upright arm members 32*a*. The upper ends of the upright arm members 32*a* are radiused in an outward direction (see FIG. 5) generally at right angles to the longitudinal length of the upright arms 32*a*. The upper outer ends 32*c* of the arms 32*a* are coaxially aligned along an axis 40 for pivotal rotation thereabout such that the swinging footrest assembly 30 pivots in a rotational pendulum swinging motion about the axis 40. The upper outer ends 32*c* of the upright arms 32*a* are secured within a pair of nylon bushing or bearings 34 which are mounted within a first pair of oppositely disposed aligned holes 36 formed through the inner surfaces of the intermediate crossbar members 15*c* (see FIG. 3). The first pair of holes 36 in the intermediate crossbar 15*c* are aligned generally toward the "front" end of the desk. The nylon bushings 34 provide smooth, reduced friction and quiet rotational motion of the swinging footrest assembly relative to the intermediate crossbars 15*c* about the first axis 40. The lower transverse member 32*b* of the swinging footrest assembly 30 can directly act as a foot support, and has, in the preferred embodiment, a length of approximately 22 inches. In the preferred embodiment, the support arm 32 is formed of ⅝ inch steel tubing; However, a preferred enhancement of the tubular footrest 32*b* includes a pedal-like foot support platform 38 rotatably secured to the lower transverse member 32*b* in a manner similar to the mounting of a bicycle pedal to its support arm. The invention includes other types of foot support structure mounting to the lower transverse members 32*b* or otherwise mounted to the upright aims 32*a* of the swinging footrest assembly 30. Further, while a generally U-shaped swinging footrest assembly 30 has been illustrated, other swinging support structures having different configurations including those having a single downwardly depending support arm are included within the spirit and intent of this invention.

According to a preferred embodiment of the invention, the intermediate crossbar 15*c* includes 3 pairs of spaced support holes for the swinging footrest assembly 30, spaced from one another along the length of the intermediate crossbar 15*c* to provide second and third mounting positions for axes of rotation for the swinging footrest assembly 30 which are progressively further away from the front end of the desk. Such alternative footrest mounting positions accommodate varied needs of the desk users. In the preferred embodiment, the second set of mounting holes 37 (FIG. 3) are spaced approximately 2 inches back from the first set of mounting holes 36, and the third set of mounting holes 39 are spaced approximately 6 inches back from the first set of mounting holes 36, or approximately at the center of the intermediate crossbar 15*c*. In the preferred embodiment the first pair of support holes 36 are spaced approximately 3 inches back from the front edge of the lower leg members 15*a*, which provides a measure of clearance between the footrest assembly 30 and the user's stationery leg and foot that is positioned on the floor.

To adjust the mounting position of the swinging footrest assembly 30 from one set of support holes (for example holes 36) to a second set of support holes (for example holes 37), one simply needs to provide sufficient inward pressure to the upper arms 32*a* of the footrest assembly 30 to remove the outer ends 32*c* of the arms 32 from engagement with their bushings 34 and to thus release the U-shaped support arm 32 from the crossbars 15*c*. The bushings 34 are then removed from holes 36 and repositioned and mounted within the next desired set of holes (for example holes 37). The upper arms 32*a* of the support arm 32 can then be squeezed toward each other and inserted into the repositioned bushings 34 to reattach the footrest assembly 30 to the crossbars 15*c*. It will be understood that the holes 36, 37 and 39 could also contain permanently affixed support bushings, and that other forms of connecting apparatus could be used to pivotally secure the footrest assembly 30 to the desk.

It is desirable to have the lower transverse member 32*b* and the foot support platform 38 (if employed) as close to the floor as possible in order to provide relatively effortless and naturally free operation thereof by the user. In the preferred embodiment, the upper foot support surface of the lower transverse member 32*b* or the upper surface of pedal support platform 38 are preferably positioned between about 3 to 5 inches from the floor.

While the swinging footrest assembly 30 is illustrated as being supported from the intermediate crossbar members 15*c*, it would be understood that the footrest can be supported from other structures including for example, from support structures directly connected to the desk top 12 or to the upper shelf 22. It is desirable to have the upper axis 40 of the footrest assembly to be positioned substantially above that of the lower footrest axis 42, such that the swinging footrest assembly 30 incorporates a fairly long radius arm which allows free pendulum swinging motion of the footrest In the preferred embodiment illustrated, the swing radius arm of motion for the swing footrest assembly 30 about its upper axis 40 is preferably longer than about 9 inches and more preferably longer than about 11 or 12 inches. Further it will be understood that the length of the radius arm can be adjusted by, for example, providing for length adjustment of the upright aim portions 32*a* of the support arm 32.

While the swinging footrest assembly 30 has been described with respect to the preferred embodiments of the invention illustrated in the figures, it will be understood by those skilled in the art that the swinging footrest assembly 30 could be applied as an add-on or retrofit accessory to other pieces of furniture or to existing desks or work stations through the use of appropriate mounting brackets or the like. Therefore, the swinging footrest assembly concept with a footrest having a relatively long swing radius has novelty in its own right as an accessory to furniture, as well as being an integral part of a larger desk or work piece structure.

Figure 6:
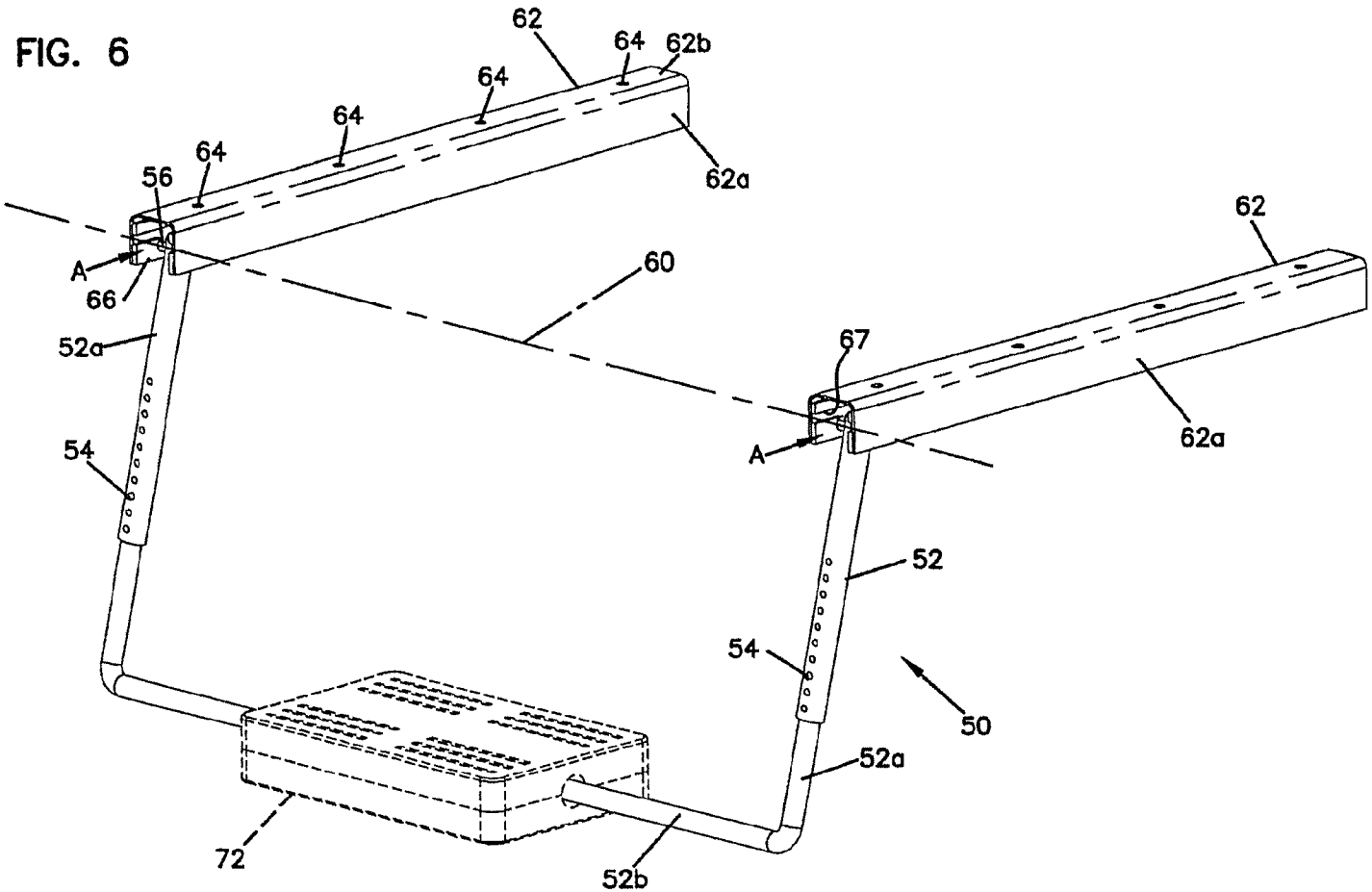
FIG. 6 is a perspective view of a pendulum swinging footrest assembly configured for retrofit connection to a desk, table or other type of workstation.
Figure 7:
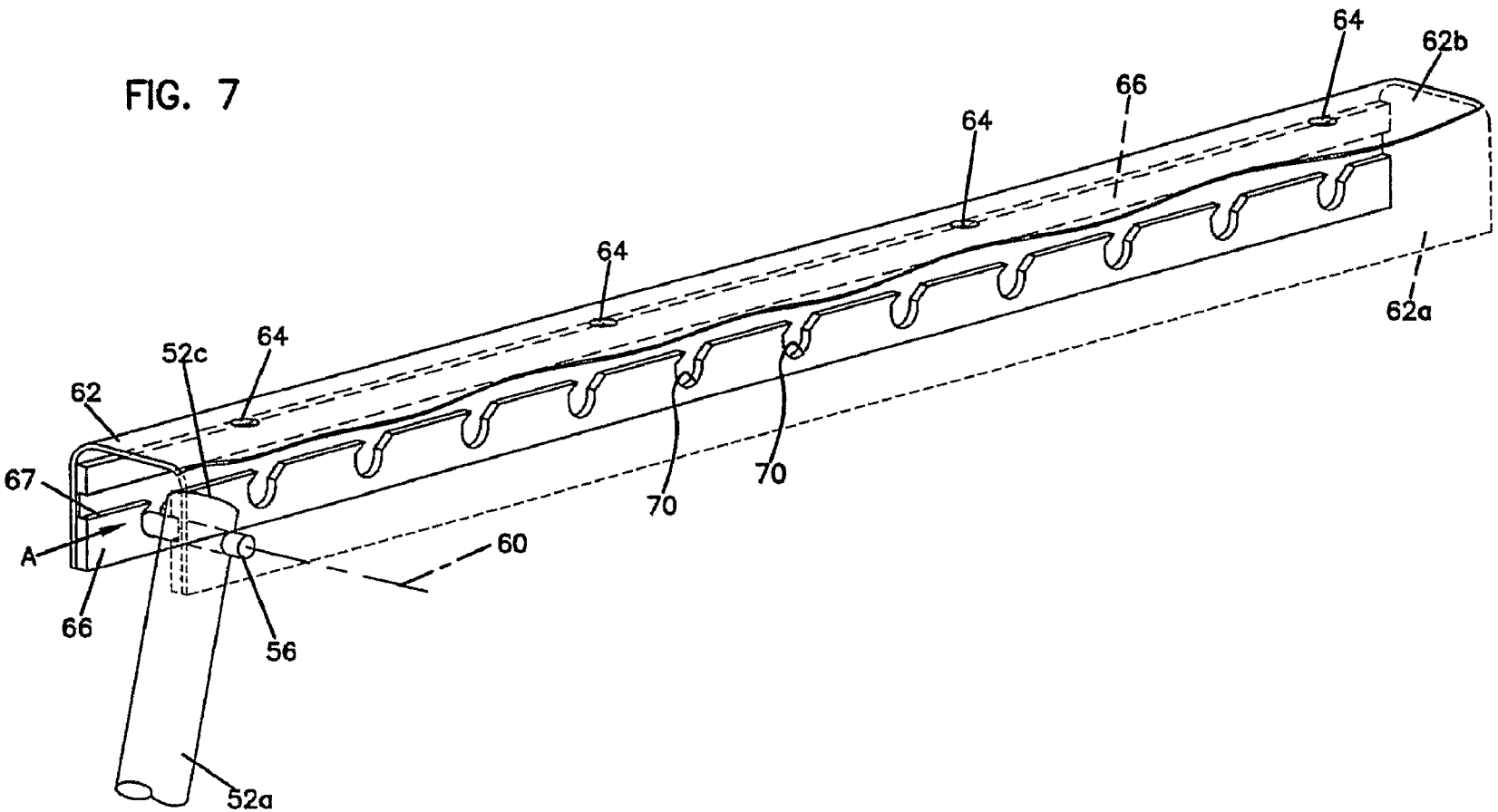
FIG. 7 is an enlarged fragmentary view of the attachment bracket portion of the footrest assembly of FIG. 6.

Referring to FIGS. 6 and 7, a pendulum swinging footrest assembly 50 configured for retrofit attachment to an existing desk, table or other type of workstation having an upper work surface is illustrated. The function and purpose of the footrest assembly 50 is the same as that of the footrest assembly 30 previously described. It provides the same advantages as the previously described footrest to a person standing or sitting adjacent the workstation and resting one or both feet for swinging motion, on the footrest assembly. It should be noted that the FIG. 6 depiction of the footrest assembly as well as depictions in the other Figures are not drawn to scale.

The footrest assembly 50 has a generally U-shaped downwardly depending 30 support arm 52, having a pair of downwardly depending spaced upright arms 52*a* connected at their lower ends by a transverse bar member 52*b*, similar in concept to the footrest assembly 32. Each of the upright arms 52*a* comprises a pair of coaxially and telescopically arranged tube members connected together by a spring biased button release mechanism 54 that enables selective lengthening or shortening of the upright side arms 52*a*, in a manner well known in the art. Each of the upright arms 52*a* terminates at an upper end 52*c*. It will be understood that the invention also contemplates use of a fixed length support arm 52 that is not adjustable. Spaced slightly back from the arm ends 52*c*, each arm has a pair of cylindrical stud members 56 radially projecting in opposed manner, out from the outer surfaces of the arms and extending in the same plane defined by the arms 52*a* and the transverse bar member 52*b*. The stud members 56 are coaxially aligned along an axis of rotation 60, about which the U-shaped support arm 52 swings or rotates in pendulum fashion. As with the previously described desk assembly embodiment, a pedal like foot platform 72 illustrated in phantom, can be rotatably secured to the lower foot-engaging transverse bar 52*b* if desired, in a manner similar to the foot support platform 38 previously described.

A pair of symmetrically shaped mounting brackets 62 mount the support arm 52 to the bottom of the upper work surface member (not illustrated) of the desk, table or workstation to which the footrest assembly is to be attached. In the embodiment illustrated, each of the mounting brackets 62 comprises an outer elongate inverted U-shaped member having a pair of downwardly projecting sidewalls 62*a* connected by an upper transverse mounting plate 62*b*. A plurality of spaced holes 64 are drilled through the mounting plate 62*b* through which mounting screws (not illustrated) can be inserted for securing the mounting plate 62*b* to the bottom surface of the desk top piece. The inside surfaces of the sidewalls 62*a* are lined with a thick layer of phenolic material 66 that is appropriately secured to each sidewall along its length by rivets or other fastener members. The oppositely facing surfaces of the phenolic layers 66 of each bracket 62 are spaced sufficiently apart from each other by a width that is more than the outer diameter of the upright arm ends 52*c*, to enable the arm ends 52*c* to longitudinally pass freely therebetween.

Each of the phenolic layers 66 defines a recessed rectangular slot or channel 67 30 longitudinally extending along the length of the layer as illustrated in FIG. 7. The width of each slot (in the vertical direction) is sized significantly larger than the diameter of the stud members 56 to enable relatively unimpeded sliding motion of the studs along the slots. The transverse spacing across the brace and between the "bottoms" of the opposing slots of each brace is slightly more than the combined lengths of the two studs and the outer diameter of the support arm upper end 52*c* such that the two studs 56 for each support arm member 52*a* slidably ride within and along the length of the slots 67 to slidably retainably secure the upper ends 52*c* of the support arms 52*a* to the bracket 62 when the support arms are positioned such that the axes of their studs are perpendicular to the phenolic layer surfaces. Each of the slots 67 further includes a plurality of spaced detents 70 formed in the phenolic layer, having generally the same "depth" as the slot channel and forming a downward extension of the slot at predetermined spaced intervals therealong. The longitudinal positioning of such detents along the slots 67 are identical and aligned for both brackets. The width (in the bracket longitudinal direction) of each detent and its length (in the vertical direction) are slightly larger than the diameter of the stud members 56 such that a stud member will be retainably held by the detent but be allowed to pivotally rotate about the stud axis while retained by the detent. The detent channels may also preferably be slightly angled toward the forward or open end of the bracket in the downward direction, to assist in retaining the studs within the detent and to keep them from popping up into the upper channel 67 during operation.

The footrest assembly 50 may be provided in kit form, for subsequent attachment and assembly, for example, to a desk, table or workstation. In kit form, the U-shaped support arm 52 and the two mounting brackets 67 may be separated from one another.

The brackets 67 are appropriately secured in parallel laterally spaced manner at the desired position along the desk by screws through the mounting holes 64 to the bottom of the desk top or to another support structure of the desk. The brackets are laterally spaced along the bottom of the desk top during mounting such that the center lines of their mounting plates 62*b* are spaced the same distance apart as the axes of the upright support arm ends 52*c*. The support arm ends 52*c* are then simultaneously inserted into the exposed open ends of the mounted brackets (illustrated by the letter "A" in the Figures) such that the support arm studs 58 ride within and along the opposed slot channels 67 of the respective brackets. As the studs 58 ride along the slot channels 67, they will drop into the first encountered set of detents 70, and be operatively held thereby as previously described. If that mounting position for the footrest assembly is desired, the footrest assembly is ready for operation, and the footrest will swing in pendulum fashion about the coaxial stud axes as retained within the first detents. If a more "recessed" (relative to the open insertion end "A" of the bracket) operative position for the support arm 52 is desired, the user needs simply to apply upward pressure to the support aim 52 to remove the studs 56 from the first detents and then apply "forward" pressure toward the desk, to slide the studs along the channels 67 to the second or subsequently desired detent positions.

In the preferred embodiment, the support arm 52 is preferably constructed of ⅝ inch tubular steel and the outer portions of the brackets 62 are preferably constructed of channel iron material. The phenolic layers defining the channel and detent stud support portions of the brackets provide strong low friction support for the swinging portions of the footrest assembly and minimize noise or squeaks during the footrest pendulum swinging motion.

It will be appreciated that the materials used for constructing the desks can vary as desired. In the preferred embodiments, the metal portions of the base and swinging footrest assembly and shelves are constructed of powder-coated steel. Powder Coating is scratch resistant and very durable, and provides a reliable surface for classroom desks which are subject to heavy use. However, it would be understood that other materials could equally well be used within the spirit and intent of this invention. Further, in one of the preferred embodiments, the upper desk top 12 is constructed of durable % inch thick medium density fiberboard (MDF) covered with a protective coating of phenolic plastic or thermoplastic material. A preferred thermoplastic material that can be vacuum pressed over the MDF base is a material sold under the Trade Name Kydex® which is fire resistant and stands up to regular cleaning with harsh or caustic cleaning solutions. Obviously, the Kydex® covered work station 12 can be obtained in multiple custom colors.

It will be appreciated that the desk and footrest assembly described herein provides significant benefits to schools by offering a long term investment that benefits both the student and the school. By allowing the student more freedom of movement, the invention desk serves to improve student comfort and therefore the student's time spent in the classroom. The adjustment flexibility of the desk allows the same desk to be used in any classroom from kindergarten to high school and beyond. The flexibility of use of the desk reduces the long term need of desk owners to purchase different sized desks for different classrooms.

The pendulum swinging footrest feature allows the user to use the footrest while in either sitting or standing positions. Typically the desk assembly will be used with an adjustable height stool, rather than with a chair having a back support. A user can use the footrest to improve his or her posture with increased comfort. Improved comfort leads to improved learning through greater attention with more quality time being able to be spent on tasks being performed by the student. Freedom of movement of the user also helps to burn off excess energy and may help increase caloric expenditure. Besides the adjustable height feature over a wide range of height adjustment, which allows the desks to be positioned for sitting or standing use, the desk design allows for the use of differently sized desk tops, with the same base or leg structure to satisfy different classroom needs and/or different student needs.

While the invention has been described with reference to preferred embodiments, the invention is not to be limited to the described embodiments, or to the use of specific components, configurations or materials that might be described herein. AU alternative modifications and variations of the present assembly are included within the scope of this invention as set forth in the appended claims.

What is claimed:

1. A desk comprising:

a desktop;

a first set of front and rear legs depending from the desktop;

a first bar extending between the first set of front and rear legs;

a second set of front and rear legs depending from the desktop located opposite the first set of front and rear legs;

a second bar extending between the second set of front and rear legs;

a swinging foot-support assembly comprising, a first rod depending from the first bar and swingingly attached to a location on the first bar and attached to a foot-support rod at a location on the first rod spaced apart from the swingingly attached location on the first bar, a second rod depending from the second bar and swingingly attached to a location on the second bar and attached to the foot-support rod at a location on the second rod spaced apart from the swingingly attached location on the second bar; and wherein the foot-support member is configured to swing back and forth in a pendulum-like manner by the first and second rods at their swingingly attached locations on the first and second bars.

2. The desk of claim 1, wherein the swingingly attached location on the first bar is positioned opposite, and faces, the swingingly attached location on the second bar.

3. The desk of claim 1, further comprising a platform on the foot-support rod.

4. The desk of claim 1, wherein each of the first and second sets of front and rear legs are telescopingly movable to raise or lower the desk.

5. The desk of claim 1, wherein the first rod swings back and forth in a pendulum-like manner underneath the first bar and the second rod swings back and forth in a pendulum-like manner underneath the second bar.

* * * * *